US007090321B2

(12) United States Patent
Koyama

(10) Patent No.: US 7,090,321 B2
(45) Date of Patent: Aug. 15, 2006

(54) INK-JET HEAD CONTROL CIRCUIT, INK-JET HEAD MODULE, DATA TRANSMISSION METHOD, AND LIQUID DROP DISCHARGE APPARATUS

(75) Inventor: Minoru Koyama, Matsumoto (JP)

(73) Assignee: Seiko Epson Corporation, (JP)

( * ) Notice: Subject to any disclaimer, the term of this patent is extended or adjusted under 35 U.S.C. 154(b) by 239 days.

(21) Appl. No.: 10/782,403

(22) Filed: Feb. 19, 2004

(65) Prior Publication Data

US 2004/0223012 A1 Nov. 11, 2004

(30) Foreign Application Priority Data

Feb. 21, 2003 (JP) ..... 2003-044368

(51) Int. Cl.
*B41J 29/38* (2006.01)

(52) U.S. Cl. ..... 347/9; 347/10; 347/11; 347/12

(58) Field of Classification Search ..... 347/9
See application file for complete search history.

(56) References Cited

U.S. PATENT DOCUMENTS 5,543,828 A * 8/1996 Minowa ..... 347/195
6,897,887 B1 * 5/2005 Miyajima et al. ..... 347/195

FOREIGN PATENT DOCUMENTS

| | | |
|---|---|---|
| JP | 05-116282 | 5/1993 |
| JP | 09/039272 | 2/1997 |
| JP | 2002-264366 | 9/2002 |

* cited by examiner

*Primary Examiner*—Thinh Nguyen
*Assistant Examiner*—Brian J. Goldberg
(74) *Attorney, Agent, or Firm*—Harness, Dickey & Pierce, P.L.C.

(57) ABSTRACT

An ink-jet head control circuit is provided that includes a latch circuit which respectively stores a first data block and a second data block following the first data block, for ink liquid drop discharge, and a data determination unit which calculates a state transition data block based on the stored first and second data blocks. If the first data block is the same as the second data block, the data determination unit outputs a state transition data block having a first value (Low), and if the first data block is different from the second data block, the data determination unit outputs a state transition data block having a second value (High).

4 Claims, 10 Drawing Sheets

PRIOR ART

PRIOR ART

INK-JET HEAD CONTROL CIRCUIT, INK-JET HEAD MODULE, DATA TRANSMISSION METHOD, AND LIQUID DROP DISCHARGE APPARATUS

RELATED APPLICATIONS

This application claims priority to Japanese Patent Application No. 2003-044368 filed Feb. 21, 2003 which is hereby expressly incorporated by reference herein in its entirety.

BACKGROUND OF THE INVENTION

1. Technical Field of the Invention

The present invention relates to an ink-jet head control circuit, an ink-jet head module, a data transmission method, and a liquid drop discharge apparatus.

2. Description of the Related Art

An overview of a head unit of an ink-jet liquid drop discharge apparatus and a driving device thereof will be described with reference to FIG. 10.

FIG. 10 schematically shows the structure of a liquid drop discharge apparatus 900 comprising an information processor main body 910 (hereinafter, referred to as a driving device) that is a control subject, and a head unit 950 to be controlled. In FIG. 10, the driving device 910 includes a driving signal generator 915 which generates a driving signal $V_{out}$ to discharge liquid drops through a plurality of nozzles, and a data storage unit, which converts driving data input from a high-rank unit (not shown) into data having a structure suitable for transmission to the head unit 950 and outputs the converted driving data in series, that is, a latch circuit 911, and a shift register 913. A print timing signal (PTS) for driving is input to the latch circuit 911 from the high-rank unit, and the latch circuit 911 receives driving data input at a rising edge of the print timing signal PTS and stores the input driving data.

A latch signal LAT, which is obtained by delaying the print timing signal PTS for a predetermined amount of time, is supplied to the driving signal generator 915 from the high-rank unit. In addition, a static voltage $V_H$ of about 30 V is applied to the driving signal generator 915 and becomes a power source for a driving signal. The driving signal data input from a data bus is digital-to-analog (D/A) converted by the driving signal generator 915 and is output as the driving signal $V_{out}$.

Further, as shown in FIG. 10, the head unit 950 includes a shift register 951 for inputting data DATA which is driving information for each nozzle, a latch circuit 952 which stores the data DATA of the shift register 951, a selector 953 which selects driving/non-driving, and a nozzle driving unit 954 which has an actuator for driving a nozzle (not shown) communicating with each of a plurality of liquid drop containers. The shift register 951 converts the data DATA that is input serial data, into parallel data. The latch circuit 952 is a data storage unit that stores the parallel data output from the shift register 951 for each nozzle. In addition, the selector 953 is configured so that the driving signal $V_{out}$ is transmitted from the driving device 910, driving information distributed for each nozzle is applied to a desired nozzle only during driving and is not applied to the desired nozzle during non-driving. In the nozzle driving unit 954, actuators to which the driving signal $V_{out}$ is applied are driven and liquid drops are discharged through a plurality of nozzles. A logic power source $V_{cc}$ and a ground line GND are power source lines. A voltage of +5 V or +3.3 V is supplied to the logic power source $V_{cc}$.

An object substrate on which liquid drops are discharged using the aforementioned ink-jet liquid drop discharge apparatus has become larger. As the object substrate becomes larger, a distance that a head unit and a table on which a substrate is installed make a relative motion, that is, a main scanning distance becomes longer. The head unit and the driving device are connected through a flexible flat cable (FFC), for example. As the main scanning distance becomes longer, a signal path, such as an FFC, also becomes longer. If the signal path becomes longer, the ratio of the influence of noise from the outside becomes larger. Due to the influence of noise, the liquid drop discharge apparatus cannot perform a normal discharge operation. Further, for improvement of productivity, the number of head units or the number of nozzles tends to be increased. Thus, the data transmitted to the head unit increases. As such, the power consumption of the driving device or the head unit increases. For example, since the object substrate is large in a liquid drop discharge apparatus for industrial use, the influence of noise and the increase in power consumption cannot be ignored. The influence of noise and the increase in power consumption become larger when the main scanning distance is long and liquid drops are uniformly and consecutively discharged on the object substrate (so-called, the application of liquid drops to the entire surface of a region).

The present invention has been made to address the above problem in the prior art. It is therefore an object of the present invention to provide an ink-jet head control circuit, an ink-jet head module, a data transmission method, and a liquid drop discharge apparatus to reduce the influence of noise and to have low power consumption.

SUMMARY

To address the problem and attain the object described above, according to the present invention, there is provided an ink-jet head control circuit comprising: a data storage unit, which respectively stores a first data block and a second data block following the first data block, for liquid drop discharge; and a data conversion unit, which calculates a state transition data block based on the first and second stored data blocks. If the first data block is the same as the second data block, the data conversion unit outputs a state transition data block having a first value, and if the first data block is different from the second data block, the data conversion unit outputs a state transition data block having a second value.

In a conventional head control circuit, a data block for liquid drop discharge is output to a head module. On the other hand, according to the present invention, a state transition data block calculated based on first and second data blocks for liquid drop discharge, instead of the data block for liquid drop discharge, is output. Here, the state transition data block is two-value data having a first value when the first data block is the same as the second data block and a second value when the first data block is different from the second data block. The value of the state transition data block varies only when there is a variation in a difference between data blocks to be compared. For example, when the first data block, the second data block, . . . , and an n-th data block have the same value, a difference between the compared data blocks is uniform, and there is no variation in the difference. Thus, in this case, the state transition data block maintains the first value. Only when there is a variation in the difference between the compared data blocks, the first value of the state transition data block is changed to the second value. The state transition data block reflects only varied information between original data blocks. For example, when the entire surface of an object substrate is to be treated, the same data block (discharge data) is consecutively output to the head module. In this case, since there is no variation in the data block, the amount of information of the state transition data block may be very small. The data conversion unit for the head control circuit converts the stored data block for liquid drop discharge into the state transition data steam. As a result, liquid drop discharge can be precisely performed using a small amount of information. Since the amount of information of the state transition data block is small, even when the main scanning distance is long, the influence of noise can be reduced. Further, since the amount of information of the state transition data block is small, the power consumption can be reduced.

In addition, according to a preferred embodiment of the present invention, the ink-jet head control circuit is preferably provided in a driving device that outputs the state transition data block to an ink-jet head module for discharging liquid drops through a plurality of nozzles. Thus, state transition information can be transmitted simply by connecting the driving device to the head module.

In addition, according to a preferred embodiment of the present invention, the ink-jet head control circuit is preferably provided in a computer connected to a driving device that outputs the state transition data block to an ink-jet head module for discharging liquid drops through a plurality of nozzles. Thus, the driving device can be compact and the apparatus can be smaller.

According to the present invention, there can be provided an ink-jet head module for discharging liquid drops through a plurality of nozzles, comprising: a data storage unit, which stores a state transition data block calculated based on first and second data blocks for liquid drop discharge; and a data conversion unit, which converts the stored state transition data block into a data block for liquid drop discharge. If the state transition data block has a first value, the data conversion unit determines that the first data block to be the same as the second data block, and if the state transition data block has a second value, the data conversion unit determines that the first data block to be different from the second data block. In a conventional head module, discharge of liquid drops if performed based on a data block for liquid drop discharge from a driving device. On the other hand, according to the present invention, the head module receives the above-described state transition data block from the driving device. The data conversion unit also converts the state transition data block into a data block for liquid drop discharge. For this reason, liquid drop discharge can be precisely performed based on the state transition data block having a reduced amount of information. As a result, even when the main scanning distance is long, the influence of noise can be reduced. Further, since the amount of information of the state transition data block is small, the power consumption can be reduced.

According to the present invention, there can be provided a data transmission method of interfacing the above-described ink-jet head control circuit and the above-described ink-jet head module. Thus, data transmitted between the ink-jet head control circuit and the ink-jet head module can be output and input as state transition information having a compressed amount of data. As a result, even when the main scanning distance is long, the influence of noise can be reduced. Further, since the data amount of the state transition data block is small, the power consumption can be reduced. In particular, when the same data is repeatedly transmitted to same nozzle, an increased effect can be expected.

According to the present invention, there can be provided a liquid drop discharge apparatus comprising the above-described ink-jet head control circuit and the above-described ink-jet head module. The liquid drop discharge apparatus includes the ink-jet head control circuit and the ink-jet head module by combining them. Thus, state transition information having a small amount of data can be output from the head control circuit to the head module. As a result, even when the main scanning distance is long, the influence of noise can be reduced. Further, since the data amount of the state transition data block is small, the power consumption can be reduced.

DETAILED DESCRIPTION

FIRST EMBODIMENT

Figure 1:
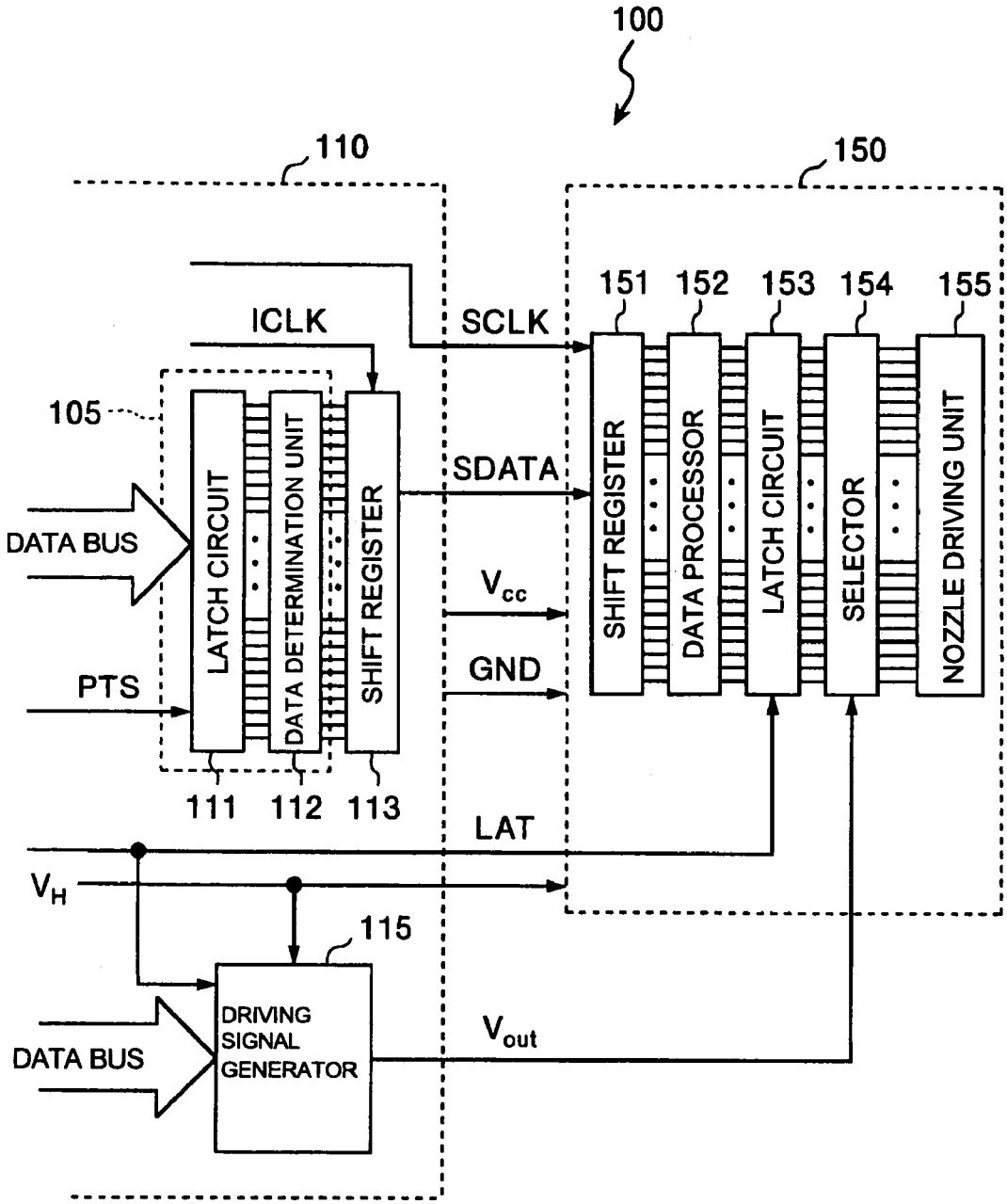
FIG. 1 schematically shows the structure of a driving device and a head unit according to a first embodiment of the present invention.

Hereinafter, preferred embodiments of the present invention will be described with reference to the accompanying drawings. First, an overview of a driving device 110 having an ink-jet head control circuit 105 according to a first embodiment of the present invention will be described with reference to FIG. 1. FIG. 1 shows a liquid drop discharge apparatus 100 comprising a driving device 110 for an ink-jet head module which is an information processor main body (hereinafter, referred to as a driving device) as a control subject, and a head unit 150 to be controlled. In FIG. 1, the driving device 110 includes a driving signal generator 115 which generates a driving signal $V_{out}$ to discharge liquid drops through a plurality of nozzles, and a data storage unit, which converts a data block input from a high-rank unit (not shown) into data having a structure suitable for transmission to the head unit 150 and outputs the converted driving data in series, that is, a latch circuit 111, and a shift register 113. A print timing signal PTS is input to the latch circuit 111 from the high-rank unit, and the latch circuit 111 receives input driving data at a rising edge of the print timing signal PTS and stores the input driving data.

A latch signal LAT, which is obtained by delaying the print timing signal PTS for a predetermined amount of time, is supplied to the driving signal generator 115 from the high-rank unit. In addition, a static voltage $V_H$ of about 30 V is applied to the driving signal generator 115 and becomes a power source for a driving signal. The driving signal data input from a data bus is digital-to-analog (D/A) converted by the driving signal generator 115 and is output as the driving signal $V_{out}$.

In addition, a data determination unit 112 that is the data conversion unit determines the contents of the stored data block. The data determination unit 112 will be described later in detail. A clock signal generator (not shown) generates an internal shift clock signal ICLK to drive the shift shifter 113 in the driving device 110 and an external shift clock signal SCLK to drive a shift register 151 in the head unit 150. The shift register 113 converts a parallel state transition data block into a serial data block SDATA and outputs the serial data block SDATA to the head unit 150. The state transition data block will be described later in detail.

Next, the schematic structure of the head unit 150 will be described. The shift register 151 to which the data block SDATA that is the serially converted state transition data block is input, is provided in the head unit 150.

In addition, the head unit 150 includes a nozzle driving unit 155 having an actuator for driving a nozzle (not shown) communicating with each of a plurality of liquid drop containers, and a selector 154 for selecting a driving nozzle. A data storage unit, that is, a latch circuit 153 for processing the data block SDATA transmitted from the driving device 110 and storing the processed data block for each nozzle is provided at the preceding stage of the selector 154. During signal input of the selector 154, a driving signal $V_{out}$ transmitted from the driving device 110 is applied to the selector 154. During selective input of the selector 154, driving information distributed for each nozzle is applied to the selector 154. In the nozzle driving unit 155, actuators to which the driving signal $V_{out}$ is applied are driven, thereby discharging liquid drops through a plurality of nozzles.

For example, assuming that the frequency of the external shift clock signal SCLK in sixty four (64) nozzle heads is 1 MHz, a latch signal LAT input into the latch circuit 153 is activated in synchronization with the driving signal $V_{out}$ at a period of more than 64 μs. During this latch period, the data block SDATA that is a state transition data block at a next period, is input to a data processor 152 that is a data conversion unit, through the shift register 151. The data processor 152 calculates a data block for liquid drop discharge based on the state transition data block. The data processor 152 will be described later in detail. A data block for liquid drop discharge from the data processor 152 is latched in the latch circuit 153 and is input into the selector 154.

According to the operating timing in the above configuration, when the latch signal LAT is activated, the driving signal $V_{out}$ and the data block SDATA which is a state transition data block before one latch period, are transmitted from the driving device 110 to the head unit 150. In the head unit 150, a corresponding nozzle is driven based on a variety of transmitted signals or the data block SDATA and liquid drops are discharged to a predetermined region of a medium to be printed.

Figure 2:
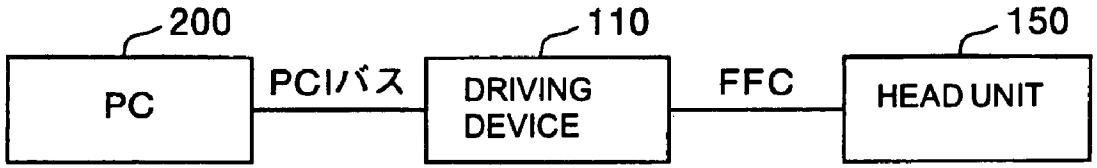
FIGS. 2(*a*) and 2(*b*) are block diagrams of the driving device according to the first embodiment of the present invention.
Figure 2:
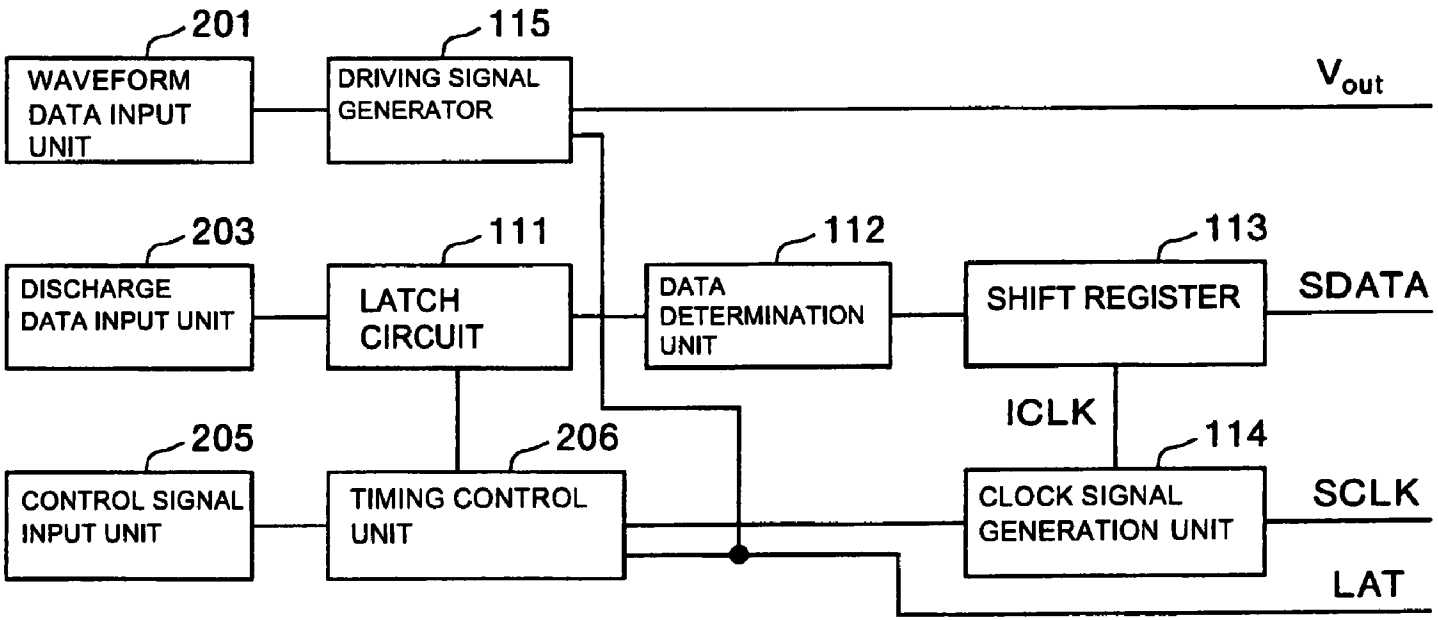

FIG. 2(*a*) is a block diagram schematically showing the liquid drop discharge apparatus 100 (FIG. 1) according to the present embodiment. As shown in FIG. 2(*a*), a control signal from a computer 200 is transmitted to the driving device 110 via a PCI bus for exclusive use. The driving device 110 and the head unit 150 are connected to each other via the flexible flat cable (hereinafter, referred to as FFC).

FIG. 2(*b*) is a block diagram schematically showing the driving device 110. Data corresponding to the amount of liquid drops discharged through the head is input into a waveform data input unit 201. The driving signal generator 115 generates a signal having a waveform shape corresponding to the amount of discharged liquid drops based on input data and outputs the generated signal as a signal $V_{out}$. In addition, data input into a discharge data input unit 203 is first stored in a latch circuit (data storage unit) 111. The data determination unit 112 calculates a state transition data block based on the stored first and second data blocks. Specifically, when the first data block is the same as the second data block, the data determination unit 112 outputs a state transition data block having a first value (Low). When the first data block is different from the second data block, the data determination unit 112 outputs a state transition data block having a second value (High). In addition, a print timing signal PTS corresponding to the discharge timing of liquid drops is input to a control signal input unit 205. A timing control unit 206 generates a latch signal LAT based on the input print timing signal PTS. The latch signal LAT is input into the driving signal generator 115 and is output to the outside through the FFC. In addition, the timing control unit 206 supplies a control signal which is triggered by the print timing signal PTS, to the latch circuit 111 and a clock signal generator 114. The clock signal generator 114 generates an internal shift clock signal ICLK which is a shift clock signal of the shift register 113, and an external shift clock signal SCLK which is a shift clock signal of an external shift register.

Figure 3:
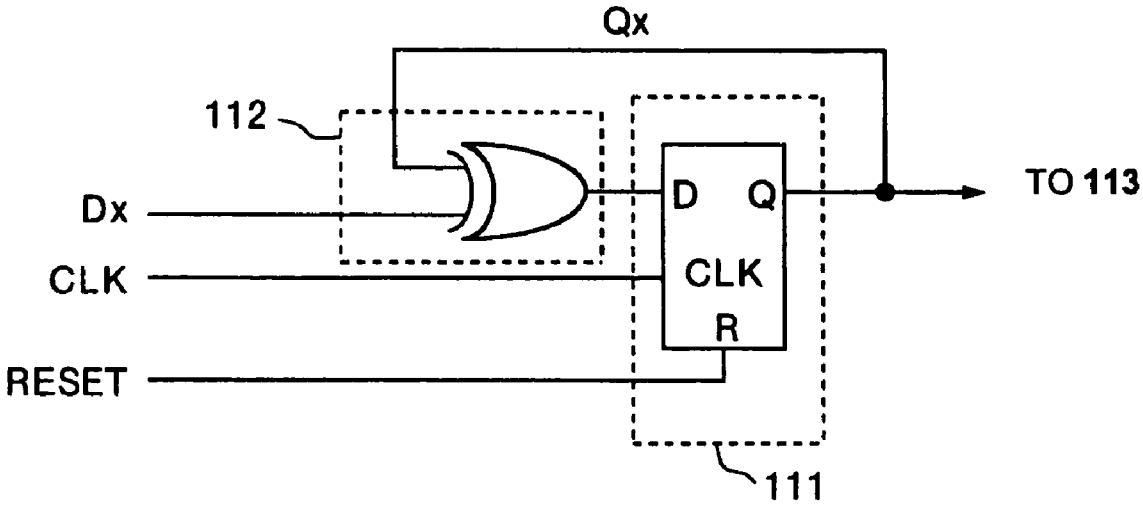
FIG. 3 is a logic circuit diagram of the driving device according to the first embodiment of the present invention.

In FIG. 3, the circuitry of the data determination unit 112 is represented by logic symbols. The data determination unit 112 compares a value of a first data block Qx (where x is 1 to n) from the latch circuit 111 with a value of a second data block Dx input following the first data block. When the first data block is the same as the second data block, the data determination unit 112 outputs 0 as a state transition data block. Specifically, for example, when the first data block is composed of discharge data (e.g., '1') and the second data block is composed of discharge data (e.g., '1'), the state transition data block is 0. In addition, a reset signal RESET is a signal for initialization when power is turned on.

Figure 4:
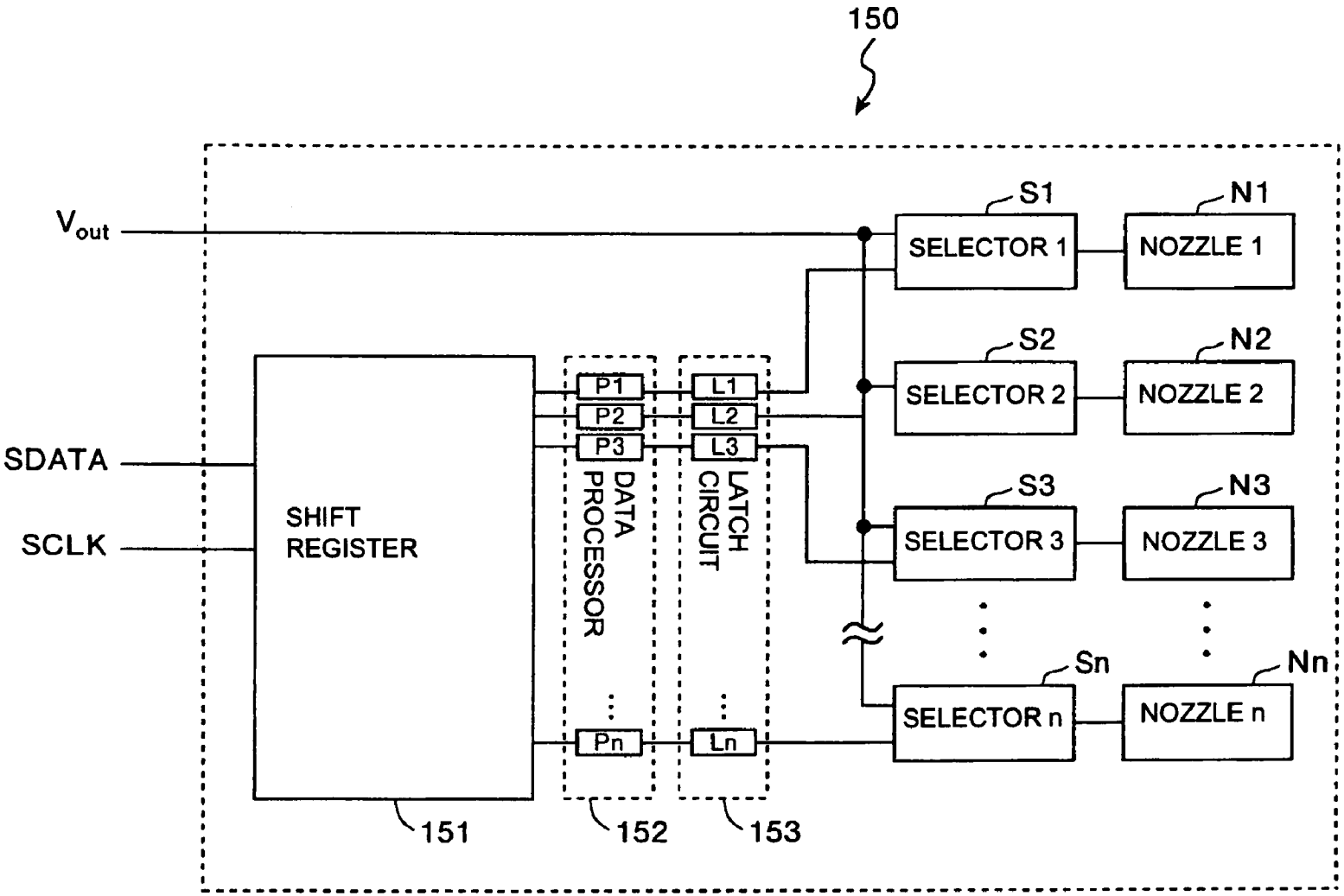
FIG. 4 is a block diagram of the head unit according to the first embodiment of the present invention.

Next, the head unit 150 will be described with reference to FIG. 4. FIG. 4 is a block diagram schematically showing the head unit 150. The data block SDATA that is a state transition data block serially input from the driving device 110 is converted in parallel and output by the shift register 151. The data block is input into the data processor 152 in parallel. The data processor 152 is connected to the latch circuit 153 that is a data storage unit for storing a state transition data block calculated based on the first data block and the second data block for liquid drop discharge. The data processor 152 converts the state transition data block stored in the latch circuit 153 into a data block for liquid drop discharge.

Specifically, when the state transition data block has a first value (Low), the data conversion unit 152 determines that the first data block is the same as the second data block. When the state transition data block has a second value (High), the data conversion unit 152 determines that the first data block is different from the second data block. The converted data block for liquid drop discharge is latched in the latch circuit 153. Next, the data block is input into n selectors S1 to Sn in parallel in accordance with discharge timing. Each of the selectors S1 to Sn is composed of, for example, analog switches. A signal from the driving signal generator 115 in the driving device 110 is input to all of the selectors S1 to Sn. Next, in accordance with the contents of the converted data block for liquid drop discharge input into each of the selectors S1 to Sn, liquid drops are discharged through the corresponding nozzles N1 to Nn. Specifically, when selective input of a selector is 1 (High), an input signal is output without changes, and when selective input of the selector is 0 (Low), the input signal is not output. Thus, liquid drops are discharged only through a nozzle having data of 1 for liquid drop discharge.

Figure 5:
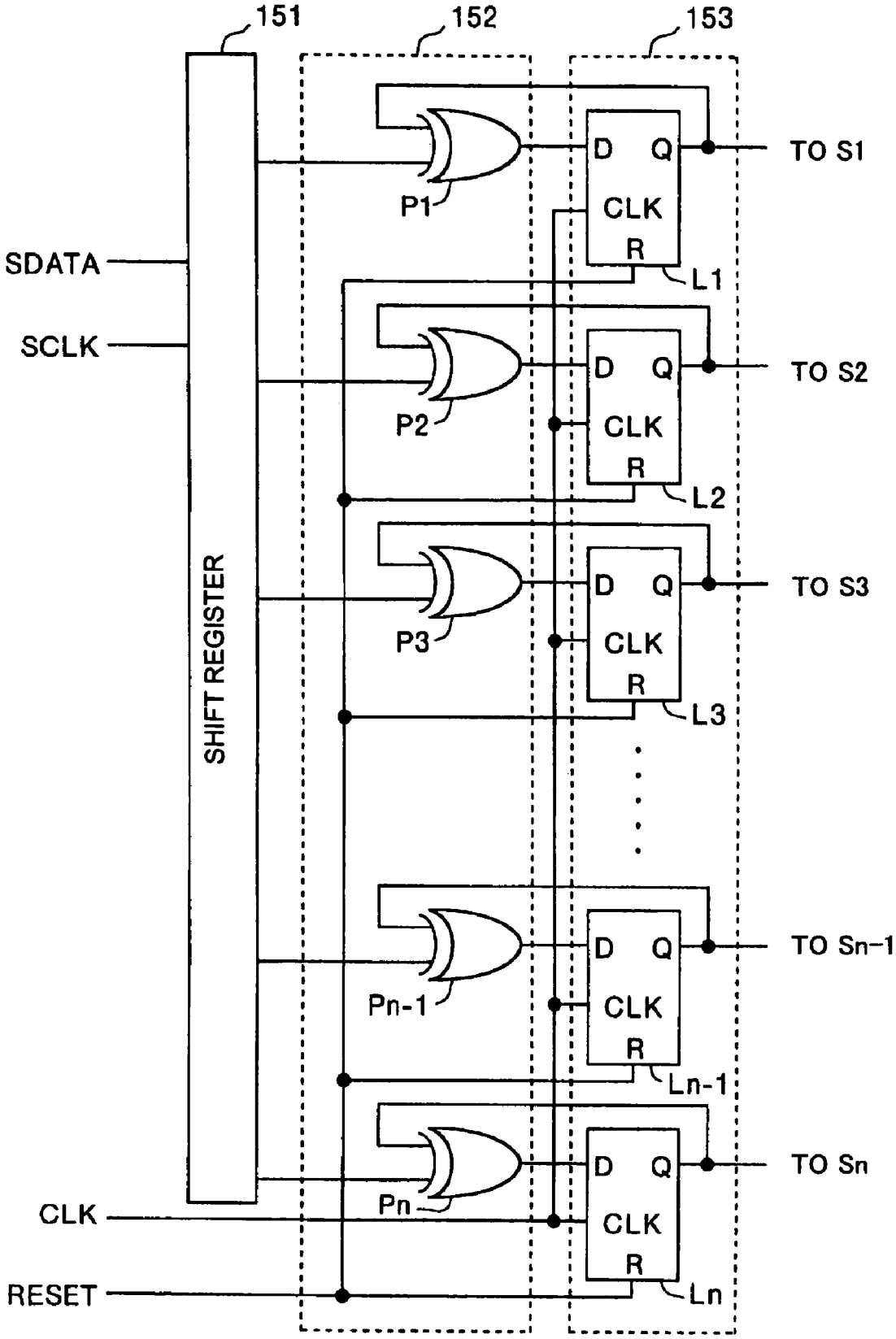
FIG. 5 is a circuit diagram of the head unit according to the first embodiment of the present invention.

FIG. 5 is a circuit diagram of the data processor 152 of the head unit 150. The same circuit as the circuit of FIG. 3 is provided in the data processor 152 with respect to each data line from the shift register 151. As such, the data processor 152 performs the same operation as that of the data determination unit 112 in the driving device 110. As a result, the data processor 152 restores the state transition data block to a data block for liquid drop discharge.

Figure 6:
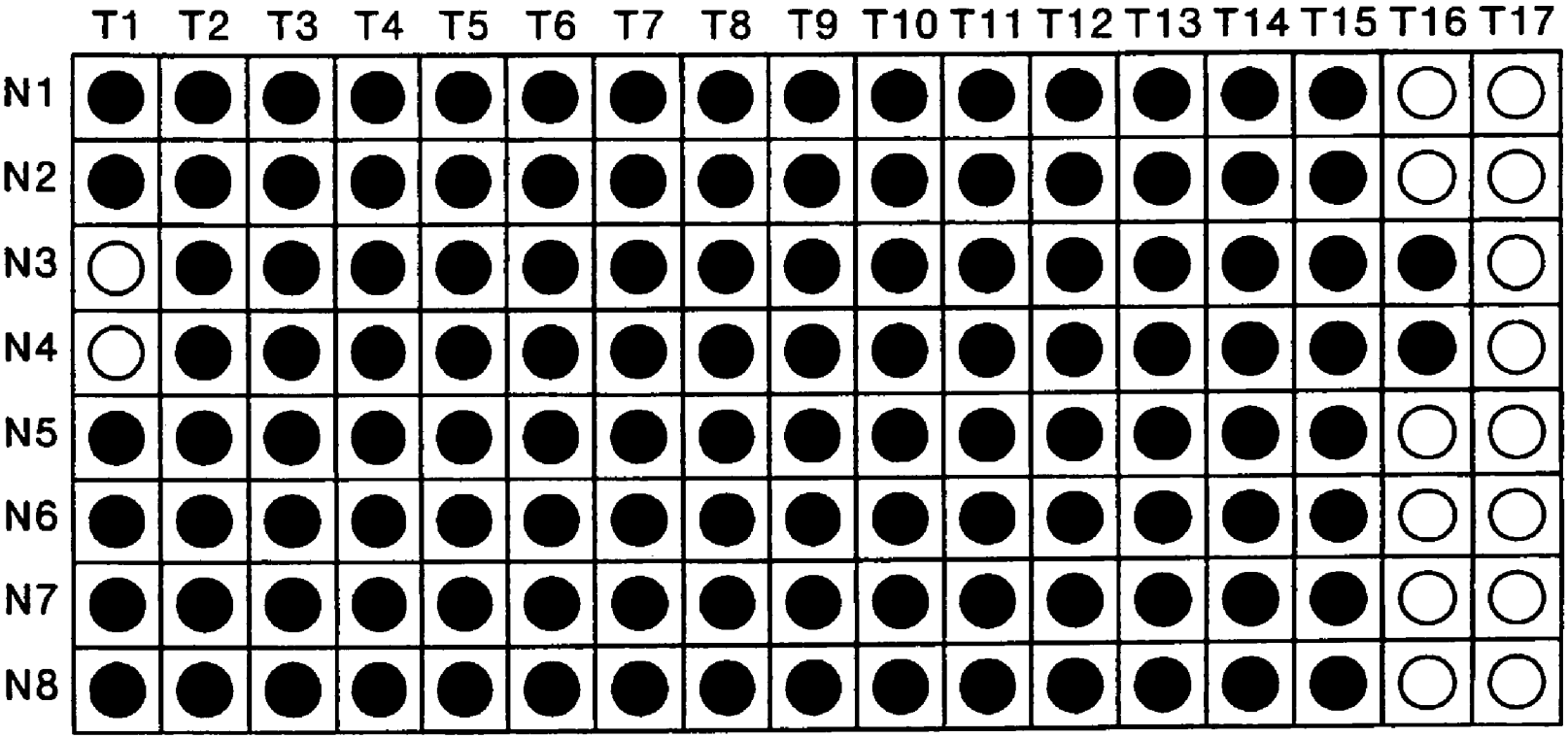
FIG. 6 shows a dot pattern.

The driving device 110 according to the present embodiment will be described in greater detail with reference to FIGS. 6, 7, and 8. FIG. 6 shows a dot pattern in a case where liquid drops are discharged through eight nozzle heads. In FIG. 6, black dots correspond to discharge data items that discharge liquid drops, and white dots correspond to non-discharge data items that do not discharge liquid drops. A data block in a column T1 is composed of eight data items of a first row N1 to an eighth row N8. If liquid drop discharge is terminated in the column T1, liquid drop discharge is performed in a column T2. This operation is sequentially and repeatedly performed and is terminated in a last column T17. The dot pattern shown in FIG. 6 corresponds to a case where the ratio occupied by discharge data (=1) is high, i.e., when liquid drops are applied to nearly the entire surface of a given region. Typical examples of such application of liquid drops to the whole surface of a region include coating a photoresist on the entire surface of an object substrate, performing hard coating on the surface of a lens, and uniformly discharging liquid drops on an overcoat region of a liquid crystal substrate.

Figure 7:
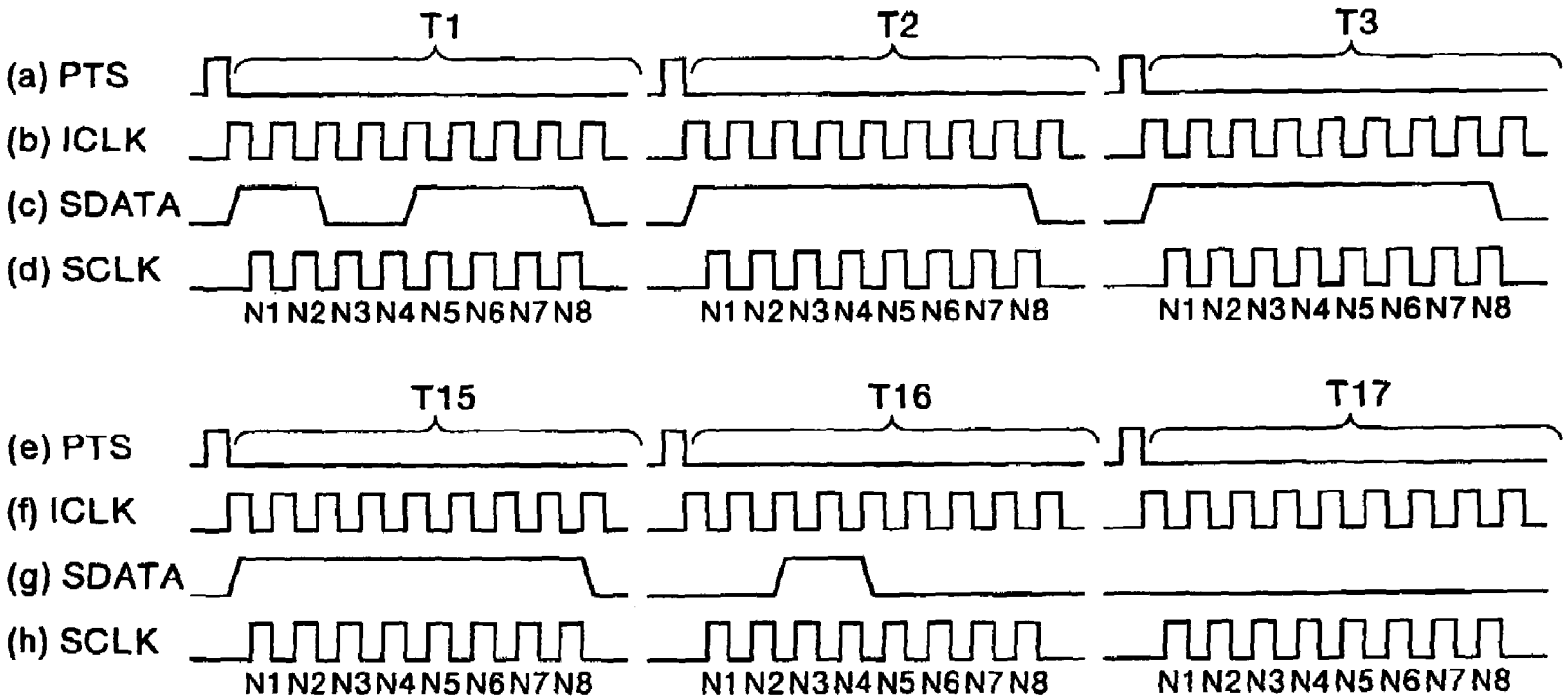
FIGS. 7(*a*)–7(*h*) are timing charts of data transmission according to prior art.

FIGS. 7(*a*) to 7(*h*) are the timing charts of a prior-art data transmission. Here, each of the rows N1 to N8 corresponds to a nozzle. For example, N1 corresponds to a first nozzle, and N8 corresponds to an eighth nozzle. FIGS. 7(*a*) to 7(*d*) are the timing charts of three columns T1, T2, and T3 when a printing operation starts. FIGS. 7(*e*) to 7(*h*) are the timing charts of three columns T15, T16, and T17 when the printing operation is terminated. For example, with respect to a first column T1, a third row N3 and a fourth row N4 are non-discharge data that is represented as white dots, and rows N1, N2, and N5 to N8 except the third and fourth rows N3 and N4 are discharge data that is represented as black dots. With respect to the first column T1, in the case of the third row N3 and the fourth row N4, non-discharge data (=0) is output as the data block SDATA from the driving device 110 to the head unit 150. In the case of the rows N1, N2, and N5 to N8, discharge data (=1) is output as the data block SDATA from the driving device 110 to the head unit 150.

In addition, referring the second column T2, all the rows N1 to N8 include discharge data (=1) that is represented as black dots. In addition, with respect to the last column T17, all the rows N1 to N8 are non-discharge data (=0) that is represented as white dots. In the prior art, an input data block is output without changes regardless of the contents of the data block input into the shift register 113 of the driving device 110. As such, a data amount between the driving device 110 and the head unit 150 is increased. Thus, if the main scanning direction between the driving device 110 and the head unit 150 becomes long, the ratio of influence by noise is increased. In addition, the power consumption increases according to an increase in a data amount. This problem becomes more serious when the ratio occupied by the discharge data (=1) is high as shown in FIG. 6, i.e., when liquid drops are applied to nearly the entire surface of a region.

Figure 8:
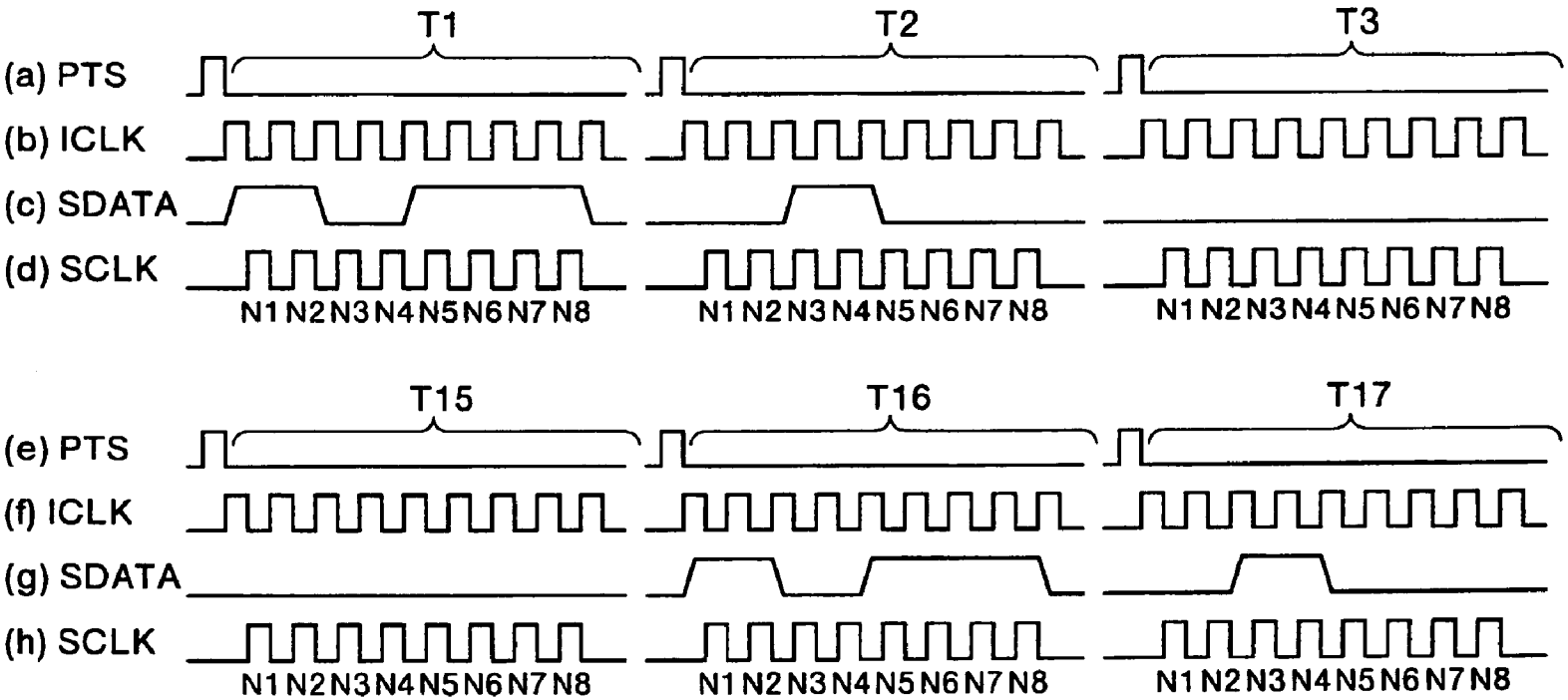
FIGS. 8(*a*)–8(*h*) are timing charts of a data transmission method according to the first embodiment of the present invention.

FIGS. 8(*a*) to 8(*h*) are the timing charts of a data transmission method of the driving device 110 according to the present embodiment. FIGS. 8(*a*) to 8(*d*) are the timing charts of three columns T1, T2, and T3 when a printing operation starts. FIGS. 8(*e*) to 8(*h*) are the timing charts of three columns T15, T16, and T17 when the printing operation is terminated. For example, with respect to a first column T1, the same result as the result of the above-described prior-art timing chart (column T1 of FIG. 7(*a*) is shown. On the other hand, with respect to a second column T2, all the data items of the rows N1 to N8 are discharge data (=1) that is represented as black dots.

Here, the first column T1 is compared with the second column T2 with respect to each row. With respect to the rows N1, N2, and N5 to N8, both the first column T1 and the second column T2 are discharge data (=1) and show the same contents. As such, as shown in the second column T2 of FIG. 8(*c*), with respect to the rows N1, N2, and N5 to N8, the data determination unit 112 outputs a first value (Low) as a data block SDATA that is a state transition data block. On the other hand, with respect to the rows N3 and N4 of the first column T1 and the second column T2, non-discharge data (=0) is changed into discharge data (=1), thereby making a difference in data. As such, as shown in the data block SDATA in the second column T2 of FIG. 8(*c*), with respect to the rows N3 and N4, the data determination unit 112 outputs a second value (High) as a state transition data block.

Next, the second column T2 is compared with the third column T3. Both the second column T2 and the third column T3 have discharge data (=1) and show the same contents for all the rows. As such, as shown in the third column T3 of FIG. 8(*c*), with respect to the rows N1 to N8, the data determination unit 112 outputs a first value (Low) as a state transition data block.

In addition, a column T15 corresponding to a third from a last column is shown in a fifteenth column T15 of FIG. 8(*g*). A fourteenth column T14 is compared with the fifteenth column T15. With respect to the rows N1 to N8, both the fourteenth column T14 and the fifteenth column T15 are discharge data (=1) and show the same contents. As such, as shown in the fifteenth column T15 of FIG. 8(*g*), with respect to the rows N1 to N8, the data determination unit 112 outputs a first value (Low) as a state transition data block.

Next, the fifteenth column T15 is compared with a sixteenth column T16. With respect to the rows N1, N2, and N5 to N8 of the first column T1 and the second column T2, discharge data (=1) is changed into non-discharge data (=0), thereby making a difference in data. As such, as shown in the sixteenth column T16 of FIG. 8(*g*), with respect to the rows N1, N2, and N5 to N8, the data determination unit 112 outputs a second value (High) as a state transition data block. On the other hand, with respect to the rows N3 and N4, both the fifteenth column T15 and the sixteenth column T16 are discharge data (=0) and show the same contents. As such, as shown in the data block SDATA in the sixteenth column T16 of FIG. 8(*g*), with respect to the rows N3 and N4, the data determination unit 112 outputs a first value (Low) as a state transition data block.

Further, the last column T17 is shown in a seventeenth column T17 of FIG. 8(*g*). The sixteenth column T16 is compared with the seventeenth column T17. With respect to the rows N1, N2, and N5 to N8, both the first column T1 and the second column T2 are non-discharge data (=0) and show the same contents. As such, as shown in the seventeenth column T17 of FIG. 8(*g*), with respect to the rows N1, N2, and N5 to N8, the data determination unit 112 outputs a first value (Low) as a state transition data block. On the other hand, with respect to the rows N3 and N4 of the sixteenth column T16 and the seventeenth column T17, discharge data (=1) is changed into non-discharge data (=0), thereby making a difference in data. As such, as shown in the data block SDATA in the seventeenth column T17 of FIG. 8(*g*), with respect to the rows N3 and N4, the data determination unit 112 outputs a second value (High) as a state transition data block.

As shown in FIGS. 8(*c*) and 8(*g*), the data amount of the data block SDATA that is the state transition data block according to the present embodiment, is much smaller than the data amount of the original discharge data and non-discharge data. As described above, the state transition data block is two-value data having a first value when the first data block is the same as the second data block and having a second value when the first data block is different from the second data block. The value of the state transition data block varies only when there is a variation in a difference between data blocks to be compared. The state transition data block reflects only information on a variation between original data blocks. As such, liquid drop discharge can be precisely performed using a small amount of data. Since the data amount of the state transition data block is small, even when the main scanning distance is long, the influence of noise can be reduced. Further, since the data amount of the state transition data block is small, the power consumption can be reduced. In particular, when repeatedly transmitting the same data to the same nozzle, a much greater effect can be expected. In addition, a high active signal is used in data transmission, but a low active signal may be used in data transmission. In this case, preferably, H-L conversion is performed on a transmitting side, and L-H conversion is performed on a receiving side.

In addition, in the present embodiment, the ink-jet head control circuit 105 is provided in the driving device 110 which outputs the data block SDATA as the state transition data block to the head unit 150 for discharging liquid drops through a plurality of nozzles. However, the present invention is not limited thereto. For example, the head control circuit 105 may be provided in a computer 200 (FIG. 2(*a*)) connected to the driving device 110 for outputting the data block SDATA as the state transition data block to the head unit 150. As such, the state transition data block is output from the computer 200 to the driving device.

As a result, a prior-art driving device may be used as the driving device. In addition, the computer 200 may execute and perform data conversion utilizing software, instead of a circuit board. Further, a computer (preferably other than the computer 200 for controlling the driving device 110) may be used as the computer in which the head control circuit 105 is provided.

SECOND EMBODIMENT

Figure 9:
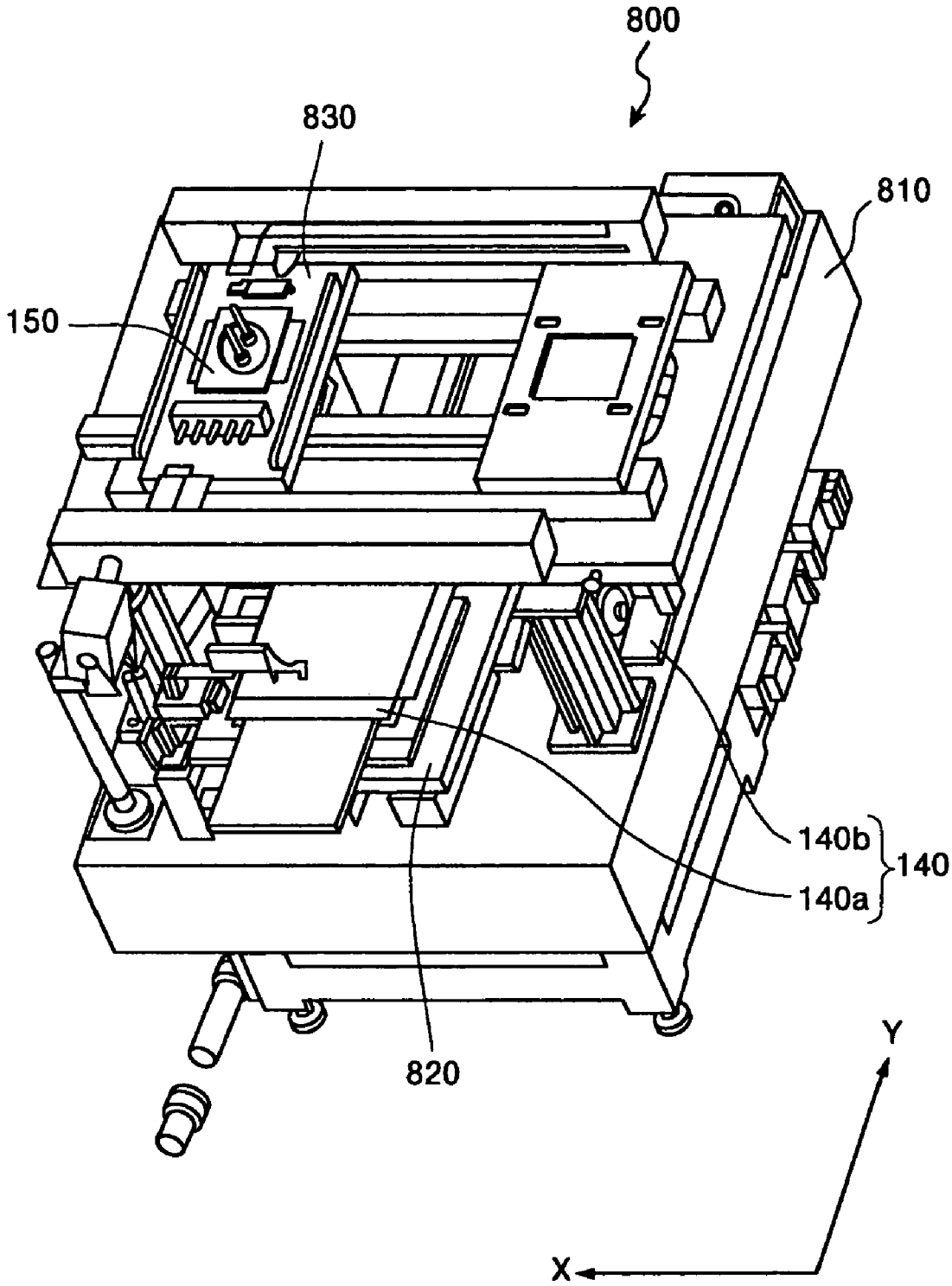
FIG. 9 is a perspective view of the structure of an ink liquid drop discharge apparatus according to a second embodiment of the present invention.
Figure 10:
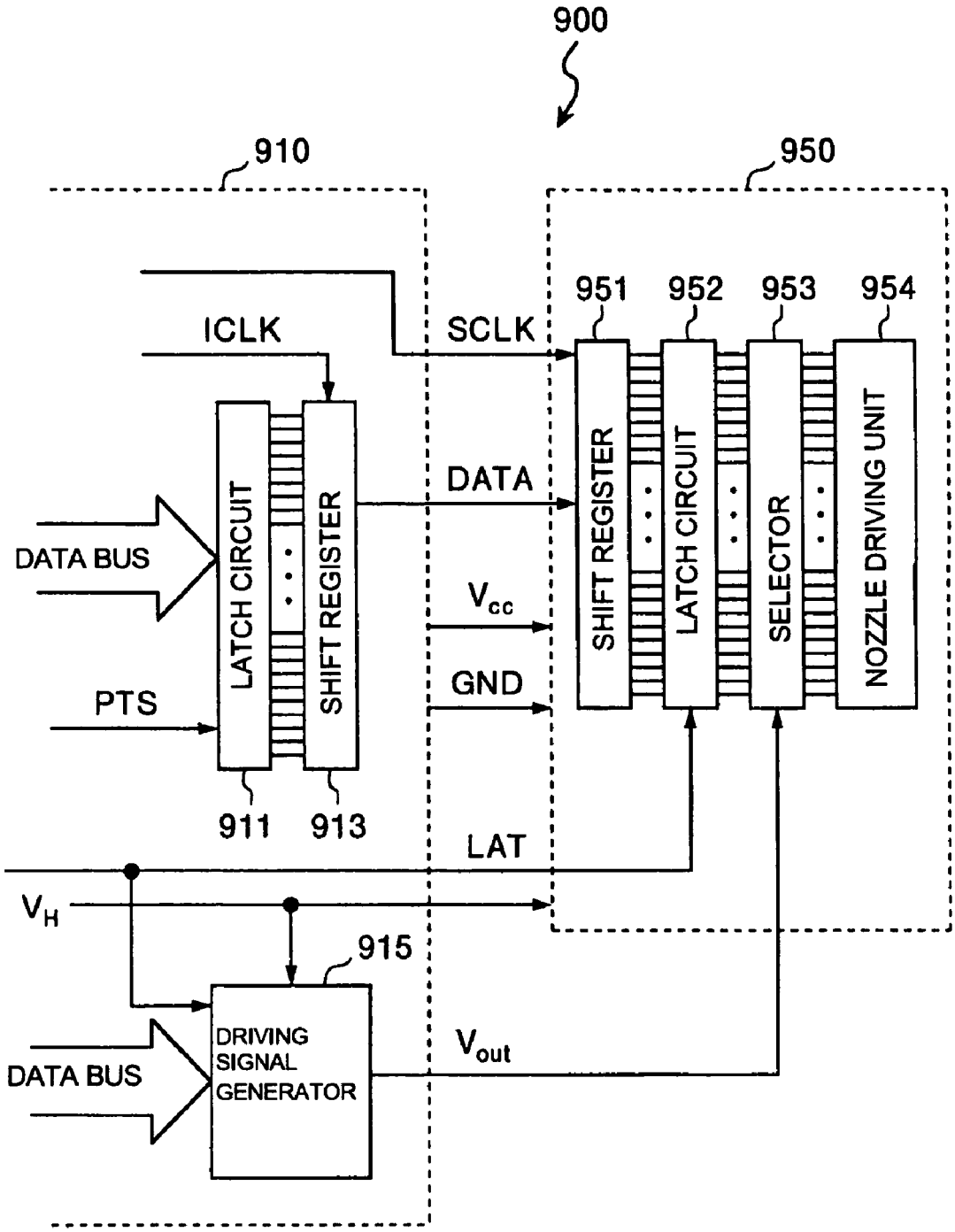
FIG. 10 schematically shows the structure of conventional driving device and head unit.

FIG. 9 schematically shows the structure of an ink liquid drop discharge apparatus according to a second embodiment of the present invention. The ink liquid drop discharge apparatus uses ink as liquid drops. As shown in FIG. 9, an ink liquid drop discharge apparatus 800 includes a base member 810. A Y-axis table 820, which mounts thereon a color filter used in a liquid drop discharge object, for example, a display device, is provided on the base member 810. The Y-axis table 820 is disposed movably in the Y-axis direction of FIG. 9. In addition, an X-axis table 830 disposed movably in the x-axis direction of FIG. 9, is provided above the Y-axis table 820. The ink-jet head unit 150, which is a liquid drop discharge unit according to the first embodiment, is provided on the X-axis table 830. In addition, the driving device (not shown) connected to the head unit 150 via the FFC according to the first embodiment, is installed on the X-axis table 830. The ink-jet head unit 150 can be moved in the x-axis direction by the X-axis table 830. Ink is discharged through the ink nozzles of the head unit 150 by an ink-jet method. Specifically, a voltage is provided to a piezoelectric element provided inside the head unit 150 and the ink is discharged through the ink nozzles by the vibration of the piezoelectric elements. According to the ink liquid drop discharge apparatus 800 according to the present embodiment, the influence of noise is reduced, and low power consumption can be achieved.

What is claimed is:

1. A liquid drop discharge apparatus comprising:

an ink-jet head control circuit including:

a data storage unit, which respectively stores a first data block and a second data block following the first data block, for liquid drop discharge;

a data conversion unit, which calculates a state transition data block based on the stored first and second data blocks, the data conversion unit outputing the state transition data block as a first value when the first data block is the same as the second data block and as a second value when the first data block is different from the second data block; and a first shift register, which receives the state transition data block from the data conversion unit and which serially outputs the state transition data block; and an ink-jet head module for discharging liquid drops through a plurality of nozzles, the ink-jet head module being in communication with the ink-jet head control circuit and including:

a second shift register, which serially receives the state transition data block from the first shift register;

a data storage unit, which stores the first data block; and a data conversion unit, which converts the received state transition data block into the second data block by determining that the second data block is the same as the first data block when the state transition data block has the first value and that the second data block is different from the first data block when the state transition data block has the second value;

wherein the ink-jet head module discharges the liquid drops through the plurality of nozzles according to the second data block.

2. The liquid drop discharge apparatus according to claim 1, wherein: the ink-jet head control circuit is provided in a driving device, which outputs the state transition data block to the ink-jet head module for discharging liquid drops through the plurality of nozzles.

3. The liquid drop discharge apparatus according to claim 1, wherein: the ink-jet head control circuit is provided in a computer connected to a driving device, which outputs the state transition data block to the ink-jet head module for discharging liquid drops through a plurality of nozzles.

4. A data transmission method for interfacing an ink-jet head control circuit with an ink-jet head module, the method comprising:

storing a first data block and a second data block following the first data block, for liquid drop discharge;

calculating a state transition data block based on the stored first and second data blocks, the state transition data block having a first value when the first data block is the same as the second data block and having a second value when the first data block is different from the second data block;

communicating the state transition data block to an ink-jet head module for discharging liquid drops through a plurality of nozzles;

converting the state transition data block into the second data block by determining that the second data block is the same as the first data block when the state transition data block has the first value and that the second data block is different from the first data block when the state transition data block has the second value; and discharging liquid drops according to the second data block.

* * * * *